United States Patent [19]

Phillips

[11] 4,208,655

[45] Jun. 17, 1980

[54] PROTECTIVE SYSTEM FOR ELECTRICAL APPARATUS

[75] Inventor: D. Colin Phillips, Monroeville, Pa.

[73] Assignee: Westinghouse Electric Corp., Pittsburgh, Pa.

[21] Appl. No.: 879,183

[22] Filed: Feb. 21, 1978

[51] Int. Cl.[2] ..... G08B 17/10

[52] U.S. Cl. ..... 340/627; 73/339 R; 250/303

[58] Field of Search ..... 340/627, 628, 629, 635, 340/647; 250/393, 302, 303; 73/339 R

[56] References Cited

U.S. PATENT DOCUMENTS

| | | | |
|---|---|---|---|
| 2,408,051 | 9/1946 | Donelian | 340/629 |
| 3,774,044 | 11/1973 | Langeron | 340/627 X |
| 3,795,904 | 3/1974 | Byersdorf et al. | 340/629 |

*Primary Examiner*—John W. Caldwell, Sr.
*Assistant Examiner*—Daniel Myer
*Attorney, Agent, or Firm*—D. R. Lackey

[57] ABSTRACT

A protective system for electrical apparatus mounted in a vault which has an opening to the atmosphere. Overheating of the electrical apparatus is distinguished from tobacco smoke, engine exhaust fumes, and other air borne particulates, by an ion chamber monitor and a thermally activated material in the vault which decomposes at a predetermined elevated temperature indicative of overheating. The material is selected to decompose above 300° C. and produce a gas which decreases the self-recombination rate of the ion in the ion detector monitor to increase the ion current. An alarm is generated on a predetermined increase in ion current, instead of upon a decrease, such as caused by particulates.

10 Claims, 6 Drawing Figures

PROTECTIVE SYSTEM FOR ELECTRICAL APPARATUS

BACKGROUND OF THE INVENTION

1. Field of the Invention

The invention relates in general to electrical apparatus, such as electrical transformers, electrical cables, and the like, and more specifically to protective systems and methods for detecting overheating of such apparatus.

2. Description of the Prior Art

The type of prior art smoke detector which includes an ion chamber, utilizes a radioactive source which emits alpha particles. The alpha particles ionize the air and the ions are collected via a charged collector electrode. In the absence of particulates, such as smoke, in the air, a steady state ion current flows through the collector electrode.

Smoke particles entering the ion chamber reduce the ion current, as the ions attach themselves to the smoke particles. The resulting combination is heavier than the ions themselves, reducing the number of ions which reach the collector electrode. An alarm circuit detects when the ion current drops from the steady state value to a predetermined smaller magnitude, and an alarm is sounded when the predetermined lower value is reached.

Some prior art ionization chamber type smoke detectors have been set up to recognize the addition of ionized air caused by the combustion gases of smokeless fires. These detectors detect an increase in the ion current from the steady state value, and alarm on a predetermined increase. U.S. Pat. Nos. 2,408,051 and 3,795,904 disclose examples of this type of detector.

Co-pending application Ser. No. 751,403, filed Dec. 16, 1976, which application is assigned to the same assignee as the present application, detects overheating of electrical apparatus cooled by a stream of hydrogen, such as hydrogen cooled dynamoelectric machines. A compound is provided within the apparatus which decomposes between 80 and 200°C. to provide a gas heavier than hydrogen. The recombination rate of the hydrogen ions is slower in the presence of this gas, thus increasing the ion current from the steady state value when this gas is present. An ion chamber monitor detects an increase in ion current caused by the presence of this gas in the hydrogen, to sound an alarm.

SUMMARY OF THE INVENTION

Briefly, the present invention relates to apparatus and methods for distinguishing the overheating of vault mounted electrical apparatus from tobacco smoke, engine exhaust fumes, and other air borne particulates which might cause a false alarm. The vaults which enclose electrical apparatus, such as transformers and electrical cables, below the street levels in our cities, must be open to the atmosphere for drainage and cooling purposes. Thus, particulates in the air will be drawn into the vault due to the thermal siphon cooling effect of the energized apparatus mounted therein. In addition, burning cigarette butts may be dropped into a vault through the grating or perforated cover. Prior art smoke detectors would not distinguish between particulates causd by overheating of the electrical apparatus and particulates from other sources.

The present invention distinguishes between overheating of the electrical apparatus and extraneous particulates by providing a coating which includes a compound selected to be thermally stable to at least 200° C., and to thermally decompose at a predetermined temperature higher than 200° C. The compound is also selected such that the thermal decomposition thereof produces a gas which reduces the self-recombination rate of the ions in an ion chamber monitor mounted in an air path in the vault. A reduction in the self-recombination rate increases the ion current from its steady state value, and a threshold or current level detector in the monitor provides an alarm signal when the ion current reaches a predetermined magnitude. The monitor provides no alarm signal upon a decrease in current, thus ignoring air borne particulates.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
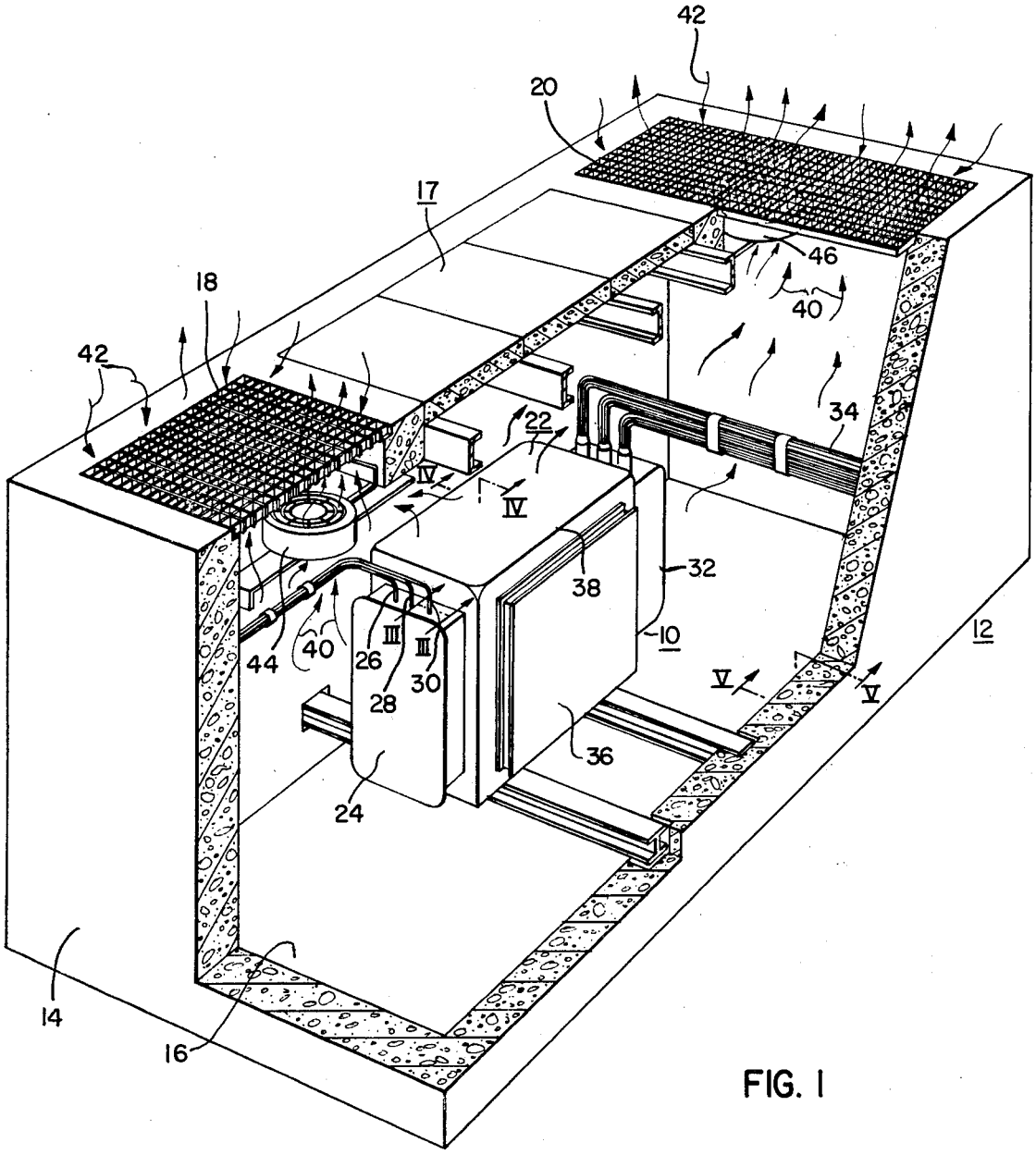
FIG. 1 is a perspective view, partially cut away, of vault mounted electrical apparatus monitored for overheating according to the teachings of the invention.

Referring now to the drawings, and to FIG. 1 in particular, there is shown vault mounted electrical apparatus 10 of the type which may be monitored and protected according to the teachings of the invention. Apparatus 10 is mounted in a vault 12 which includes side wall and bottom portions 14 and 16, respectively, usually constructed of concrete, and a top portion 17 having one or more metallic grates or covers, such as grates 18 and 20, in addition to structural steel and concrete support members. Grates 14 and 16 provide air flow paths between the electrical apparatus 10 and the atmosphere, for the purpose of properly cooling the electrical apparatus 10. The grates allow heated air to exit the vault 12 and cooler air to enter, due to natural thermal action. The free exchange of cooling air between the vault and the atmosphere is thus essential, and it makes it impractical to seal the vault. A drainage system is also required for draining the vault and preventing it from becoming flooded to the point of damaging the electrical apparatus 10. The need for ventilation and drainage may promote fire propagation in the event of a fire associated with any of the electrical apparatus 10 mounted in the vault 12.

The electrical apparatus 10 may include an electrical transformer 22, such as a network transformer, and associated switches and electrical cables. For example, a high voltage switch 24 may be mounted on one end of transformer 22 which connects the primary or high voltage winding of the transformer 22 to a source of electrical potential via electrical cables 26, 28, and 30. Further, a network protector 32 may be mounted on the opposite end of transformer 22, which connects the secondary or low voltage windings of transformer 22 to the various load circuits via a plurality of cables 34. The remaining sides of transformer 22 include heat exchangers, such as heat exchanger 36, which are disposed in fluid flow communication with the transformer tank 38. Liquid dielectric disposed in tank 38 circulates through the heat exchangers to transfer heat generated in the windings and magnetic core of transformer 22 to the surrounding air. Heated air from the tank 38, heat exchanger 36, cables 26, 28, 30, and 34, switch 24, and network protector 32, indicated by the upwardly directed arrows 40, flow through the openings provided by the grates 18 and 22. Cooler air, indicated by downwardly directed arrows 42, is drawn into the vault 12 to replace the exiting heated air.

In addition to vaults which include a transformer, many electrical distribution systems include cable splice vaults for protecting and cooling cable splices.

A fire related to the overheating of electrical apparatus mounted in a vault may be localized if detected early enough. For example, overheating due to a high resistance electrical joint may be quickly remedied if detected at an early stage, with little or no damage to surrounding cables and apparatus. If undetected, however, the oveheated joint may cause a fire which may rapidly spread to the surrounding apparatus. Other overheating problems which, if detected early enough, may be corrected with little or no damage include the heating of cables due to moisture which causes corona and the resulting degradation of insulation, and overheating of various electrical items due to road salt and other corrosive environmental contaminants. Finally, serious overheating of transformers, if detected at an early stage, may be corrected by replacement of the transformer without damage to associated apparatus.

It would thus be desirable to detect overheating of vault mounted electrical apparatus at an early stage, as it would prevent damage to associated apparatus, as well as preventing or at least minimizing electrical outages.

Electrical utilities which serve large cities may have thousands of underground vaults, and thus it is imperative that any vault monitoring system be reliable and provide an alarm only when the apparatus is overheating, or is in imminent danger from flames from another source. Conventional smoke detectors, whether of the ionization or of the photoelectric type, detect smoke particles and provide an alarm when the concentration of particulates in the air reaches a predetermined magnitude. These detectors would not be suitable for monitoring vault mounted electrical apparatus, because their environments are full of particulates provided by sources not directly associated with the electrical apparatus. For example, engine exhaust fumes and smoke from outside the vault will be drawn into the vault by the thermal action hereinbefore described. Also, burning cigarette butts may be dropped through the grating into the vault. An effective smoke alarm system for monitoring vault enclosed electrical apparatus must not alarm upon detecting such particulates.

A further requirement of a successful smoke and fire monitoring system for vault mounted electrical apparatus is to distinguish between normal hot spot temperatures of the electrical apparatus and overheating of such a nature that a serious problem will result if it is allowed to continue for a period of time.

A still further requirement of a smoke and fire detection system for vault mounted electrical apparatus is thermal stability. The calibration of the monitoring system must not degrade over a long period of time.

The present invention is a new and improved protective system which distinguishes the overheating of vault mounted electrical apparatus from particulates in the vault produced by extraneous sources. The new and improved protective system further distinguishes the overheating of vault mounted electrical apparatus from the normal hot spot temperatures thereof. Further, the protective system is thermally stable at the highest normal hot spot temperature.

The new and improved protective system of the invention utilizes an ion chamber monitor in the air flow path, or paths, set up between the electrical apparatus 10 and the atmosphere, such as ion chamber monitor 44 mounted in the air flow path associated with grate 18, and ion chamber monitor 46 mounted in the air flow path associated with grate 20. Ion chamber monitors 44 and 46 are connected into a suitable comunication system, which communicates an alarm signal or condition to a central location. The alarm signal may generate a unique coded address for the vault, or alternatively, the communication system may rapidly and sequentially address the monitors, as desired. The communication system may utilize the power conductors as the medium for transferring the alarm signal to the central location, as well known in the art, or any other suitable communication means may be used.

The ion chamber monitors 44 and 46 may be constructed similar to commercially available smoke detectors, except the alarm circuity for detecting and "alarming" on a decrease in ion current is not required. As will be hereinafter explained, the ion chamber is designed to detect and provide an alarm signal upon a predetermined increase in the ion current.

The usual prior art smoke detector detects the presence of submicron-size particles in the air. The device utilizes the concept that the particles can be detected by their influence on the output current of an ion chamber arranged to collect ions. The ions are produced by a low level radiation source. In principle, when particles are not present, almost all of the ions are collected and a maximum output current, determined by the radiation strength and ionization properties of the gas, exists. When particles are present in the gas stream, a combination of some of these ions with the particles results in an entity whose mobility is far less than the ion, which in turn results in far fewer ions being counted. The end product is a decrease in the output current of the ion chamber.

As set forth in the hereinbefore mentioned co-pending application, in certain instances, the output or ion current of an ion detector can be increased. The normal ion current, $I_O$, with no particles present is given by the following equation:

$$I_O = Qe\sqrt{q/\delta}$$

where $Q$=flow rate $e$ =electronic charge $q$ =rate of formation of ions, ion pairs/ml/sec and $\delta$=self-recombination rate of ions From the above equation, it can be seen that if $\delta$, the self-recombination rate, can be decreased, the ion current will increase. In the case of air, $\delta$ is the recombination rate for $N_2^+$ and $O_2^+$. In general, the recombination rate with any other species present would be slower. Therefore, in the latter instance, $\delta$ would be smaller and the ion current $I_O$ larger.

The present invention, in addition to an ion chamber monitor arranged to provide an alarm signal upon a predetermined increase in the ion current, includes a compound which, when subjected to a predetermined temperature, will decompose and liberate a gas which reduces the sef-recombination rate $\delta$. The thermally activated compound may be present by itself, or it may be carried by a suitable binder. The compound, or the compound and binder, which may be in the form of paint, tape, film, cement, or any other suitable form, is applied to the electrical apparatus 10. Depending upon its form, the thermally activated compound may be applied to selected areas which are particularly subject to overheating, or it may be more liberally applied, such as to substantially all exposed surfaces of the cables and the electrical apparatus associated with the cables. If the compound is in the form of a paint, the internal walls of the vault may be partially or wholly covered with the compound, if desired.

Figure 2:
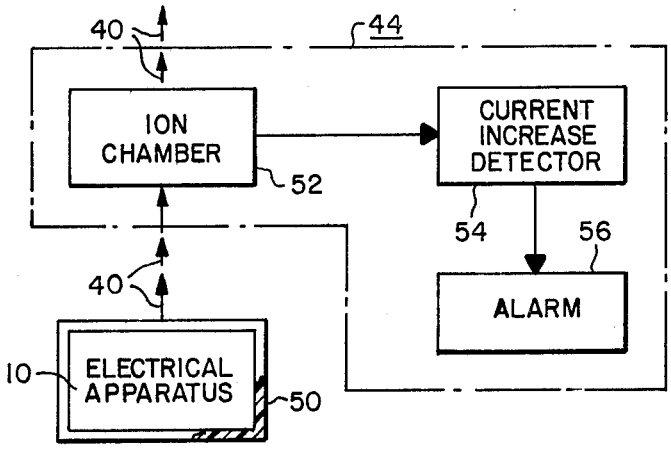
FIG. 2 is a block diagram of the monitoring apparatus shown in FIG. 1.

FIG. 2 is a block diagram which illustrates the teachings of the invention. The electrical apparatus 10 includes a thermally activated coating 50 disposed on selected portions thereof, or on substantially all exposed surfaces, which coating decomoses at a predetermined temperature to provide a gas which has the effect of reducing the self-recombination rate of an ion detector 44. The ion detector 44 includes a conventional ion detector 52 mounted in the air flow path indicated by arrows 40, a current increase detector 54, and an alarm 56. The current increase detector 54 may be a bridge circuit which detects an increase in the current provided in one arm of a bridge, compared with the current provided by a reference cell. Alternatively, it may be a level detector, such as an operational amplifier connected to change its output polarity when an input responsive to the magnitude of the ion current reaches a predetermined magnitude. Any other suitable current level detector may also be used. The alarm signal, when generated, may include an automatic transmission of the vault address over any suitable communication medium, or the alarm may set itself into an "alarm" state, to be detected by interrogation from a central communication system.

Figure 3:
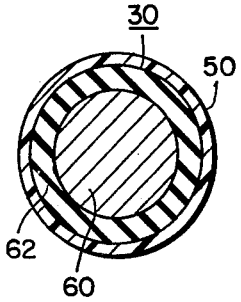
FIG. 3 is a cross-sectional view of an electrical cable shown in FIG. 1, taken between arrows III—III, illustrating a coating disposed thereon according to the teachings of the invention.
Figure 4:
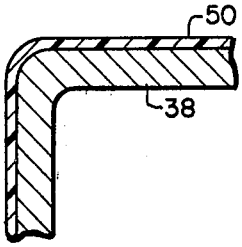
FIG. 4 is a cross-sectional view of a portion of a transformer shown in FIG. 1 taken between arrows IV—IV, illustrating a coating disposed thereon according to the teachings of the invention.
Figure 5:
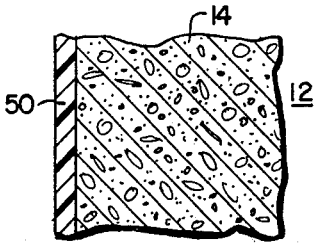
FIG. 5 is a cross-sectional view of a portion of the vault inner wall, taken between arrows V—V, illustrating a coating thereon according to the teachings of the invention.

FIGS. 3, 4 and 5 illustrate that the coating 50 may be applied to the cables, to the transformer 22, and to the internal walls fo the vault 12, respectively. FIG. 3 is a cross sectional view of cable 30 shown in FIG. 1, taken between arrows III—III. Cable 30 includes a conductor 60 surrounded by conventional cable insulation 62. A coating 50, such as a coating in the form of paint or tape, is applied over the insulation 62. FIG. 4 is a cross-sectional view of tank 38 shown in FIG. 1, taken between arrows IV—IV. The metallic tank 38 has the coating 50, which in this instance is preferably in the form of a paint, applied directly to the outer surface of the tank. FIG. 5 is a cross-sectional view of the internal surface of a side wall 14 of the vault 12, taken between arrows V—V. The coating 50 in this instance is preferably in the form of a paint, which is brushed or sprayed directly unto the surface of the inner wall.

An important criterion of the coating 50, in addition to being effective in reducing the self-recombination rate of the ions in an ion chamber when it thermally decomposes, is the fact that it must distinguish between normal hot spot temperatures and serious overheating problems. Normal hot spot temperatures of 200° C. can occur without any cause for alarm. Thus, the coating 50 must also be able to age at a temperature of 200° C. without gradually decomposing or changing its alarm temperature or characteristics. It would be desirable to provide an alarm at a predetermined temperature higher than 200° C., such as 300° C., or above, for example.

The hereinbefore mentioned co-pending application discloses many compounds which will decompose below 200° C. to provide a gas which will increase the ion curve of an ion chamber. None of these compounds are thus suitable for the present invention, since they all thermally decompose below 200° C.

I hve found two polymers suitble as the active compound in the thermally activated coating 50. A polychlorofluoroethylene, such as sold under the trade name KEL-F was found to increase the ion current of an ion chamber set to provide a steady state ion current of 0.5 mA. Isotatic polystyrene was also found to increase the ion current. With an ion chamber monitor set to provide an alarm at 0.8 ma KEL-F provided an alarm signal at 374° C., and isotactic polystyrene provided an alarm signal at 373° C. Eight other polymers thought to be thermally stable up to 200° C. were also tested, but all decreased the ion current upon thermally decomposing. The following Table summarizes the results of the tests conducted to find a suitable compound for use in the thermally activated coating 50 according to the protective system of the invention.

TABLE I

Thermoparticulation Values for Ten Polymers and the Effect of Their Products on the Ion Current of an Ion Chamber Detector

| Polymer | Class | Decrease or Increase in Ion Current | Temp. °C. | Instrument Response |
|---|---|---|---|---|
| Kapton | Polyimide | decrease | 546 | no alarm |
| Teflon | Polyfluoroethylene | decrease | 494 | no alarm |
| Polysulfone 380 | Polyarylsulfone | decrease | 438 | no alarm |
| PVF | Polyvinylfluoride | decrease | 389 | no alarm |
| Kel-F | Polychlorofluoroethylene | INCREASE | 374 | ALARM |
| Isotactic Polystyrene | Polyaromatic olefin | INCREASE | 373 | ALARM |
| Polyethylene | Polyaliphatic olefin | decrease | 370 | no alarm |
| Dacron | Polyetylene terephthalate | decrease | 345 | no alarm |

TABLE I-continued

Thermoparticulation Values for Ten Polymers and the Effect of Their Products on the Ion Current of an Ion Chamber Detector

| Polymer | Class | Decrease or Increase in Ion Current | Temp. °C. | Instrument Response |
|---|---|---|---|---|
| Polyethylene Oxide | Polyoxide | decrease | 345 | no alarm |
| Methocel HG | Cellulose | decrease | 283 | no alarm |

Kel-F and isotactic polystyrene were both aged at 200° C. in air for one month and subjected to the same analysis. Again, these polymers thermally decomposed and provided an alarm signal at the same temperatures. Thus, they appear completely suitable from the thermal stability viewpoint.

With the ion chamber monitor set the same as when the data for Table I was generated, tobacco smoke was directed into the ion chamber. The ion current decreased from 0.5 mA to 0.1 mA, and thus the monitor did not provide an alarm. Engine exhaust fumes were also passed through the detector. The ion current also decreased from 0.5 mA to 0.1 mA. Thus, no alarm was generated.

Figure 6:
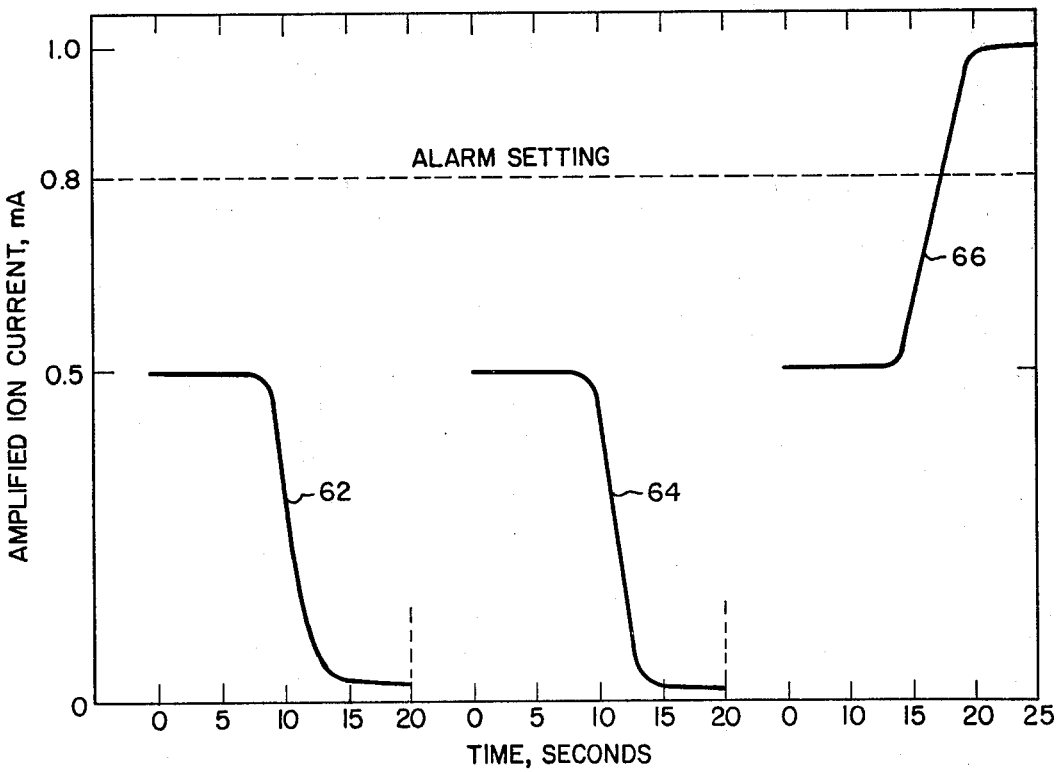
FIG. 6 is a graph which plots ion current versus time for a variety of different materials directed through an ion current monitor constructed according to the teachings of the invention.

Tobacco smoke, engine exhaust fumes, and the thermal decomposition products of Kel-F were all mixed and directed into the ion chamber, and the instrument provided an alarm signal. The ion current increased from 0.5 mA to 1 mA. The same results were obtained when tobacco smoke, engine exhaust fumes, and the thermal decomposition products of isotactic polystyrene were mixed and directed into the ion chamber. FIG. 6 illustrates the above-mentioned tests graphically, with the graph plotting the amplified ion current in milliamps on the ordinate versus time on the abscissa. Curve 62 illustrates the ion current responsive to tobacco smoke, curve 64 illustrates the ion current responsive to engine exhaust fumes, and curve 66 illustrates the ion current responsive to Kel-F or isotactic polystyrene in the temperature range 370°-380° C. taken alone or in mixture with tabacco smoke and/or engine exhaust fumes. It will be noted that an alarm is provided only when the degradation products of Kel-F or isotactic polystyrene are present, and that the alarm signal is triggered between 15 and 20 seconds after these products are directed into the ion chamber.

The binder which carries the active compound, such as Kel-F or isotactic polystyrene, must thermally age without degradation at 200° C., and it must not thermally decompose at a lower temperature than the thermal decomposition temperature of the active ingredient. Suitable high temperature binders are the soluble silicates, the ceramic cements, the polyimide-based adhesives, the silicone resins, and refractory coatings for brickwork. The active ingredient should normally be in the range of 10 to 70% ofthe total weight of the active ingredient-binder combination, with 50% being a preferred percentage. The particle size of the active ingredient is only a mechanical consideration, selected for ease in mixing and the final mechanical properties of the coating or tape. For example, if the coating is in the form of paint and it is required that it be sprayable as well as brushable, the particle size should be selected accordingly.

In summary, there has been disclosed new and improved protective apparatus and methods for monitoring and protecting vault mounted electrical apparatus. The disclosed system will not provide false alarms due to particulates in the air, such as tobacco smoke and automobile exhaust fumes, and it will allow normal heating of the electrical apparatus without providing an alarm signal. The proposed apparatus may utilize a conventinal ion chamber type smoke detector, with a modification thereof which causes the smoke detector to alarm upon a predetermined increase in ion current, instead of upon a predetermined decrease in current. The ion current monitor is used in conjunction with a thermally activated coating formulated to be thermally stable at temperatures as high as 200° C., and to thermally decompose above 300° C., and preferably in the range of 350 to 400° C. The active ingredient of the coating is selected such that the thermal decomposition products will decrease the self-recombination rate of the ions in the ion chabmer, resulting in an increase in ion current when the coating is thermally decomposed by an over-temperature condition within the vault.

I claim:

1. A protective system for electrical apparatus, comprising:

an enclosure, electrical apparatus disposed in said enclosure, said enclosure having at least one opening which defines an air path from said electrical apparatus to the atmosphere, monitoring means located to monitor the air flowig from said electrical apparatus through the at least one opening, said monitoring means including an ion chamber having a steady state ion current value which is normally reduced in magnitude by particulates, incuding tobacco smoke and engine exhaust fumes, which enter the ion chamber, a thermally activated coating on a predetermined surface within said enclosure, said coating being thermally stable up to at least 200° C., said coating including a compound selected to decompose at a temperature higher than 200° C., and to produce matter which reduces the self-recombination rate of the ions in said ion chamber, to increase the ion current, and alarm means responsive to an increse in the ion current to a predetermined value, which predetermined value is greater than said steady state value.

2. The protective system of claim 1 wherein the compound includes polychlorofluoroethylene.

3. The protective system of claim 1 wherein the compound includes isotactic polystyrene.

4. The protective system of claim 1 wherein the decomposition temperature of the compound exceeds 300° C.

5. The protective system of claim 1 wherein the enclosure is a vault and the electrical apparatus includes electrical cables.

6. The protective system of claim 1 wherein the enclosure is a vault and the electrical apparatus includes an electrical transformer.

7. The protective system of claim 1 wherein the monitoring means is disposd within the enclosure.

8. The protective system of claim 1 wherein the surface on which the coating is disposed is a surface on the electrical apparatus which may reach 200° during normal operatin thereof.

9. A method of distinguishing the overheating of electrical apparatus mounted in a vault having an opening to the atmosphere from air borne particulates, comprising the steps of:

providing an ion chamber which reduces its ion current in response to air borne particulates, disposing the ion chamber in an air flow path which includes air heated by the electrical apparatus, providing a coating of material on a predetermined surface within the vault which releases a gas upon thermal decomposition which reduces the self-recombination rate of the ions and increases the ion current of the ion chamber, and providing an alarm signal upon a predetermined increase in the ion current.

10. The method of claim 9 wherein the steps of providing a coating on a predetermined surface within the vault includes the step of coating at least a predetermined surface of the electrical apparatus.

* * * * *